US006523290B1

(12) United States Patent
Hanna et al.

(10) Patent No.: US 6,523,290 B1
(45) Date of Patent: Feb. 25, 2003

(54) GOLF CART PROMOTIONAL SYSTEM

(75) Inventors: Terry L. Hanna, 3133 N. 151st St., Omaha, NE (US) 68116; Rick A. English, 14806 Grant St., Omaha, NE (US) 68116

(73) Assignees: Terry L. Hanna, Omaha, NE (US); Rick A. English, Omaha, NE (US)

( * ) Notice: Subject to any disclaimer, the term of this patent is extended or adjusted under 35 U.S.C. 154(b) by 203 days.

(21) Appl. No.: 09/667,484

(22) Filed: Sep. 22, 2000

(51) Int. Cl.[7] ..... G09F 3/18
(52) U.S. Cl. ..... 40/661; 40/658
(58) Field of Search ..... 40/643, 658, 593, 40/661, 661.06, 652; 24/67.7, 67.11

(56) References Cited

U.S. PATENT DOCUMENTS 1,743,718 A * 1/1930 Lotter ..... 24/67.11
3,204,356 A * 9/1965 Close et al. ..... 40/658
3,553,865 A * 1/1971 Jones ..... 40/643
4,746,045 A * 5/1988 Schweim ..... 40/661 X
5,193,852 A * 3/1993 Bachmeyer ..... 40/661.06 X
5,456,034 A * 10/1995 Lewis et al. ..... 40/661 X
5,887,902 A * 3/1999 Irwin et al.
5,943,805 A * 8/1999 Huang et al. ..... 40/593 X

* cited by examiner

*Primary Examiner*—Joanne Silbermann
(74) *Attorney, Agent, or Firm*—Michael S. Neustel

(57) ABSTRACT

A golf cart promotional system for providing an effective marketing and promotional tool for conventional golf carts. The golf cart promotional system includes a retaining device, and a pair of brackets attached to the retaining device for pivotally securing to a conventional writing pad upon a conventional golf cart. The retaining device is constructed of an upper portion and a lower portion with a slot defined between thereof which is capable of receiving at least one promotional sheet. The retaining device is preferably constructed of a transparent or semi-transparent material for allowing viewing of the promotional sheet beneath the upper portion of the retaining device. The pair of brackets include a pin that extends into a side of the clip member and an insertable locking member for pivotally attaching the retaining device upon the clip member.

15 Claims, 7 Drawing Sheets

GOLF CART PROMOTIONAL SYSTEM

BACKGROUND OF THE INVENTION

1. Field of the Invention

The present invention relates generally to golf carts and more specifically it relates to a golf cart promotional system for providing an effective marketing and promotional tool for conventional golf carts.

2. Description of the Prior Art

Clipboards for golf carts have been in use for years. Typically, there is a writing pad in the center of the steering wheel that is attached to the steering column. This writing pad has a clip member that holds a golfers scorecard against the writing pad and also a pair of side apertures for receiving writing instruments such as pencils. Other related clipboards have strapped onto the steering column.

One of the problems with these clipboards is that they are occupied by a scorecard or map. This leaves no space for advertising or communication between the golfer and the golf course. Also, previous clipboards would not provide protection to the scorecard from the elements of nature.

Examples of patented clipboards or retaining devices which are illustrative of such prior art include U.S. Pat. No. 318,299 to Moberg; U.S. Pat. No. 4,955,576 to Moberg; U.S. Pat. No. 4,453,788 to Russell; U.S. Pat. No. 4,166,559 to Richardson; U.S. Pat. 4,139,217 to Jamison; U.S. Pat. No. 3,952,988 to Easterly; U.S. Pat. No. 2,150,709 to Bake; U.S. Pat. No. 1,883,714 to Gray; U.S. Pat. No. 330,915 to Shing-Wai; U.S. Pat. 331,263 to Shing-Wai.

While these devices may be suitable for the particular purpose to which they address, they are not as suitable for providing an effective marketing and promotional tool for conventional golf carts. These clipboards and retaining devices are occupied by a scorecard or map. This leaves no space for advertising or communication between the golfer and the golf course. Also, previous clipboards would not provide protection to the scorecard from the elements of nature.

In these respects, the golf cart promotional system according to the present invention substantially departs from the conventional concepts and designs of the prior art, and in so doing provides an apparatus primarily developed for the purpose of providing an effective marketing and promotional tool for the golf cart.

SUMMARY OF THE INVENTION

In view of the foregoing disadvantages inherent in the known types of clipboards and retaining devices now present in the prior art, the present invention provides a new golf cart promotional system construction wherein the same can be utilized for providing an effective marketing and promotional tool for conventional golf carts.

The general purpose of the present invention, which will be described subsequently in greater detail, is to provide a new golf cart promotional system that has many of the advantages of the retaining devices mentioned heretofore and many novel features that result in a new golf cart promotional system which is not anticipated, rendered obvious, suggested, or even implied by any of the prior art retaining devices, either alone or in any combination thereof.

To attain this, the present invention generally comprises a retaining device, and a pair of brackets attached to the retaining device for pivotally securing to a conventional writing pad upon a conventional golf cart. The retaining device is constructed of an upper portion and a lower portion with a slot defined between thereof which is capable of receiving at least one promotional sheet. The retaining device is preferably constructed of a transparent or semi-transparent material for allowing viewing of the promotional sheet beneath the upper portion of the retaining device. The pair of brackets include a pin that extends into a side of the clip member and an insertable locking member for pivotally attaching the retaining device upon the clip member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a golf cart promotional system that will overcome the shortcomings of the prior art devices.

A second object is to provide a golf cart promotional system for providing an effective marketing and promotional tool for conventional golf carts.

Another object is to provide a golf cart promotional system that protects a golfers scorecard from the elements of nature.

An additional object is to provide a golf cart promotional system that allows communication of golf course events and policies to the golfer.

A further object is to provide a golf cart promotional system that makes use of the time a golfer expends within the golf cart.

An additional object is to provide a golf cart promotional system that is easily attached to existing golf carts.

A further object is to provide a golf cart promotional system that is capable of being attached to various types of writing pads contained within the steering wheel of a conventional golf cart.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
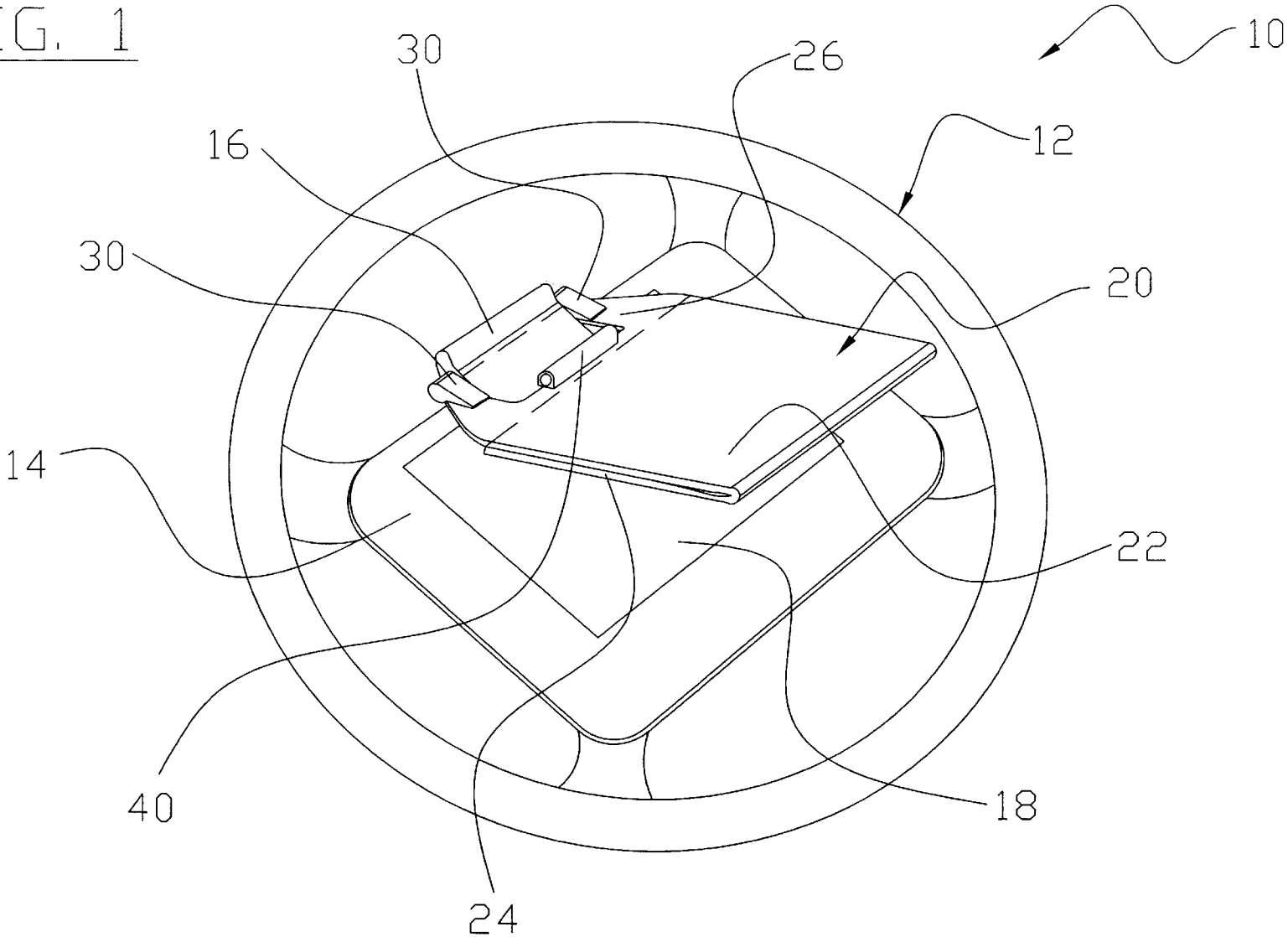
FIG. 1 is an upper left perspective view of the present invention partially flipped upward.

Turning now descriptively to the drawings, in which similar reference characters denote similar elements throughout the several views, FIGS. 1 through 9 illustrate a golf cart promotional system 10, which comprises a retaining device 20, and a pair of brackets 30 attached to the retaining device 20 for pivotally securing to a conventional writing pad 14 upon a conventional golf cart. The retaining device 20 is constructed of an upper portion 22 and a lower portion 24 with a slot 23 defined between thereof which is capable of receiving at least one promotional sheet 50. The retaining device 20 is preferably constructed of a transparent or semi-transparent material for allowing viewing of the promotional sheet 50 beneath the upper portion 22 of the retaining device 20. The pair of brackets 30 include a pin 34 that extends into a side of the clip member 16 and an insertable locking member 60 for pivotally attaching the retaining device 20 upon the clip member 16.

As shown in FIGS. 1, 2, 3, and 4 of the drawings, a writing pad 14 is positioned within the center of the steering wheel 12 that is attached to the steering column of a conventional golf cart. This writing pad 14 typically has a clip member 16 that holds a scorecard 18 adjacent the front surface of the writing pad 14. The clip member 16 typically includes a pair of opposing side bores for receiving at least one elongated writing instrument such as a pencil or pen. It can be appreciated by one skilled in the art that a writing pad 14 for a conventional golf cart may be comprised of various shapes, designs and structures and are not limited to the writing pad 14 shown within the attached drawings.

Figure 2:
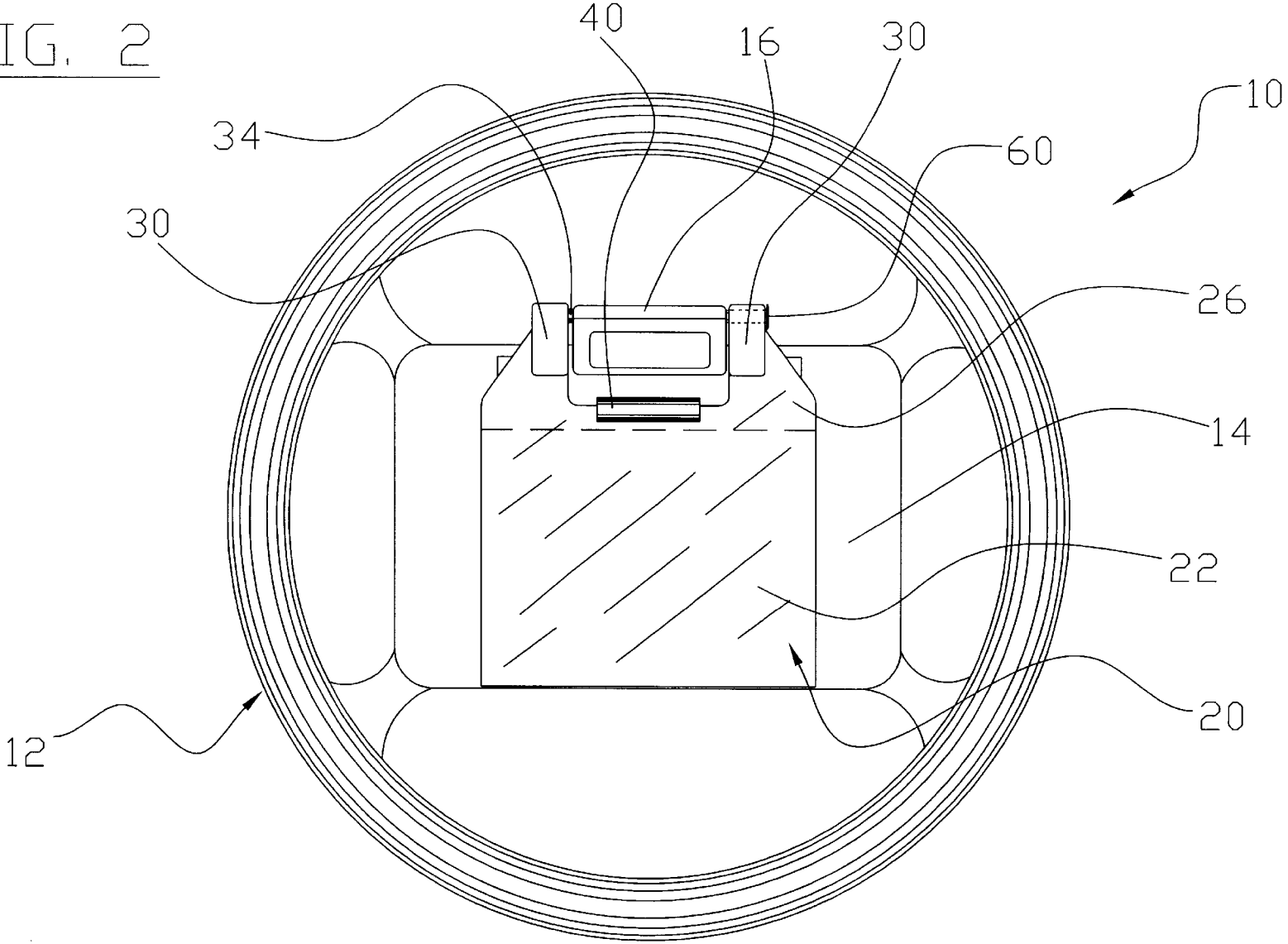
FIG. 2 is a front view showing the device attached to a golf cart wheel.
Figure 3:
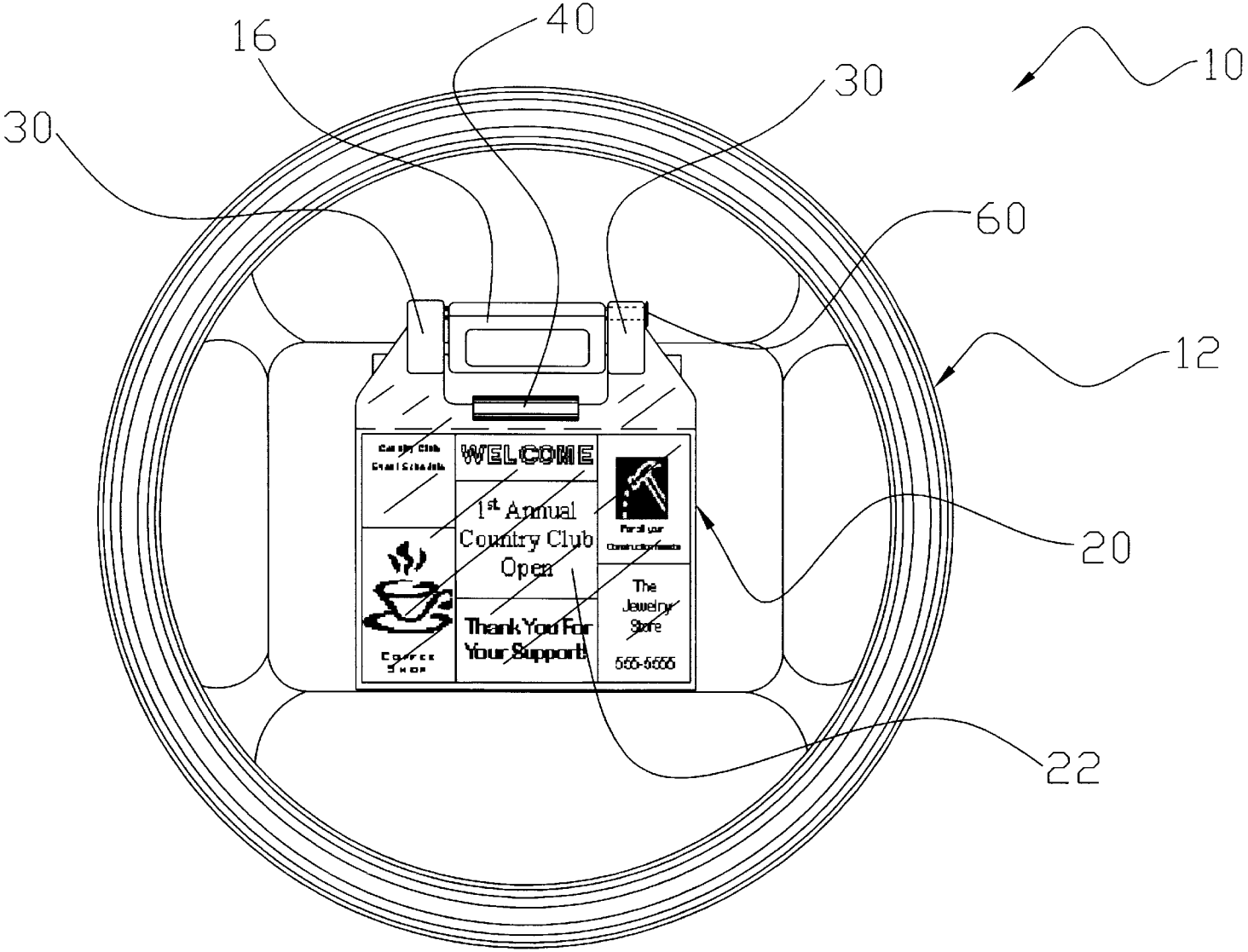
FIG. 3 is a front view with a sample promotional sheet inserted within the retaining device.
Figure 4:
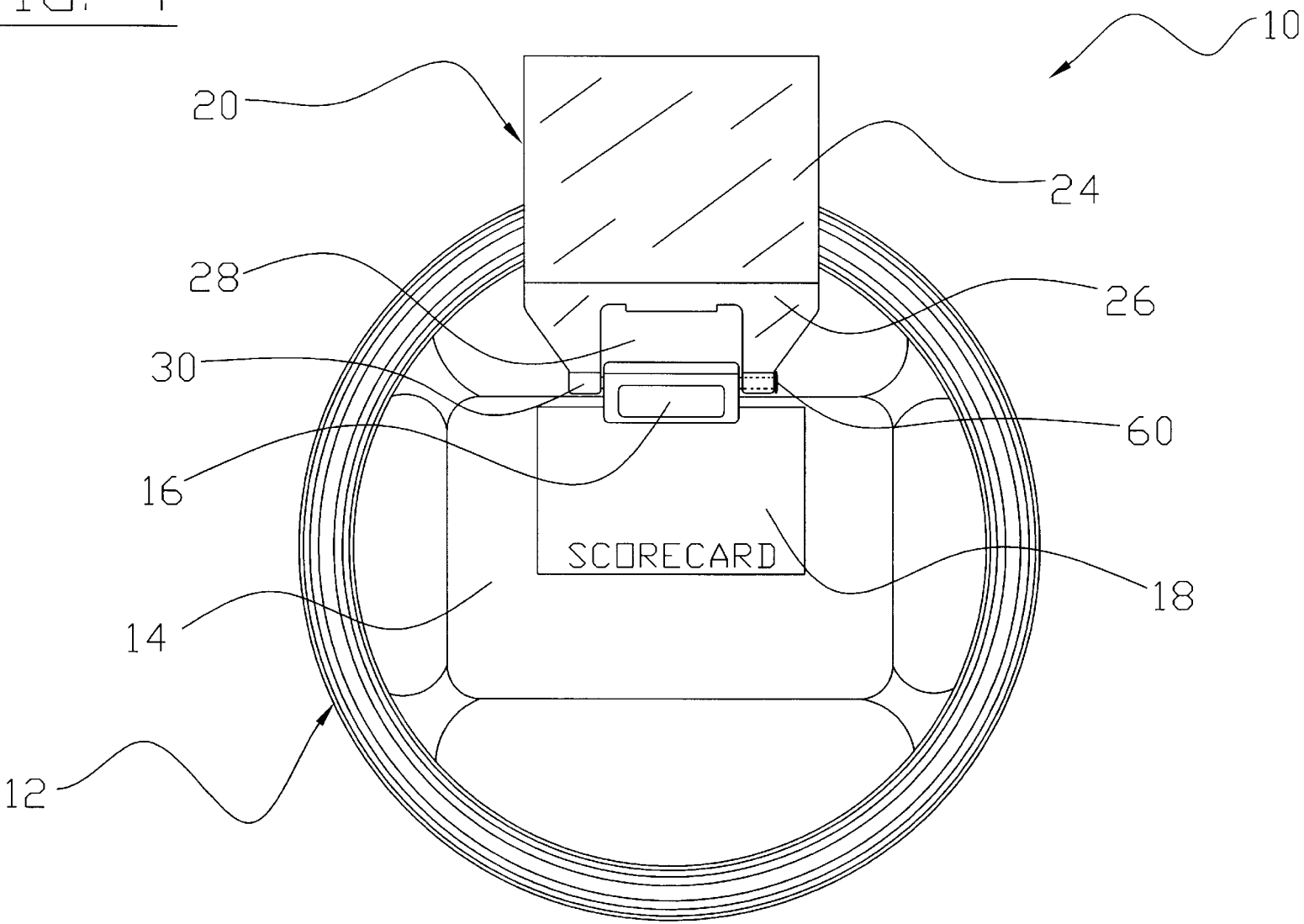
FIG. 4 is a front view of the present invention within a raised position.

As shown in FIGS. 1 through 3 of the drawings, the retaining device 20 is generally a rectangular structure, however it can be appreciated that the retaining device 20 may be comprised of various shapes and configurations. The retaining device 20 is mainly constructed of an upper portion 22 and a lower portion 24 with a slot 23 defined between thereof. The slot 23 is formed for snugly receiving at least one promotional sheet 50 or item which can be viewed through the upper portion 22 and lower portion 24. The retaining device 20 is preferably constructed of a transparent or semi-transparent material such as but not limited to plastic.

Figure 5:
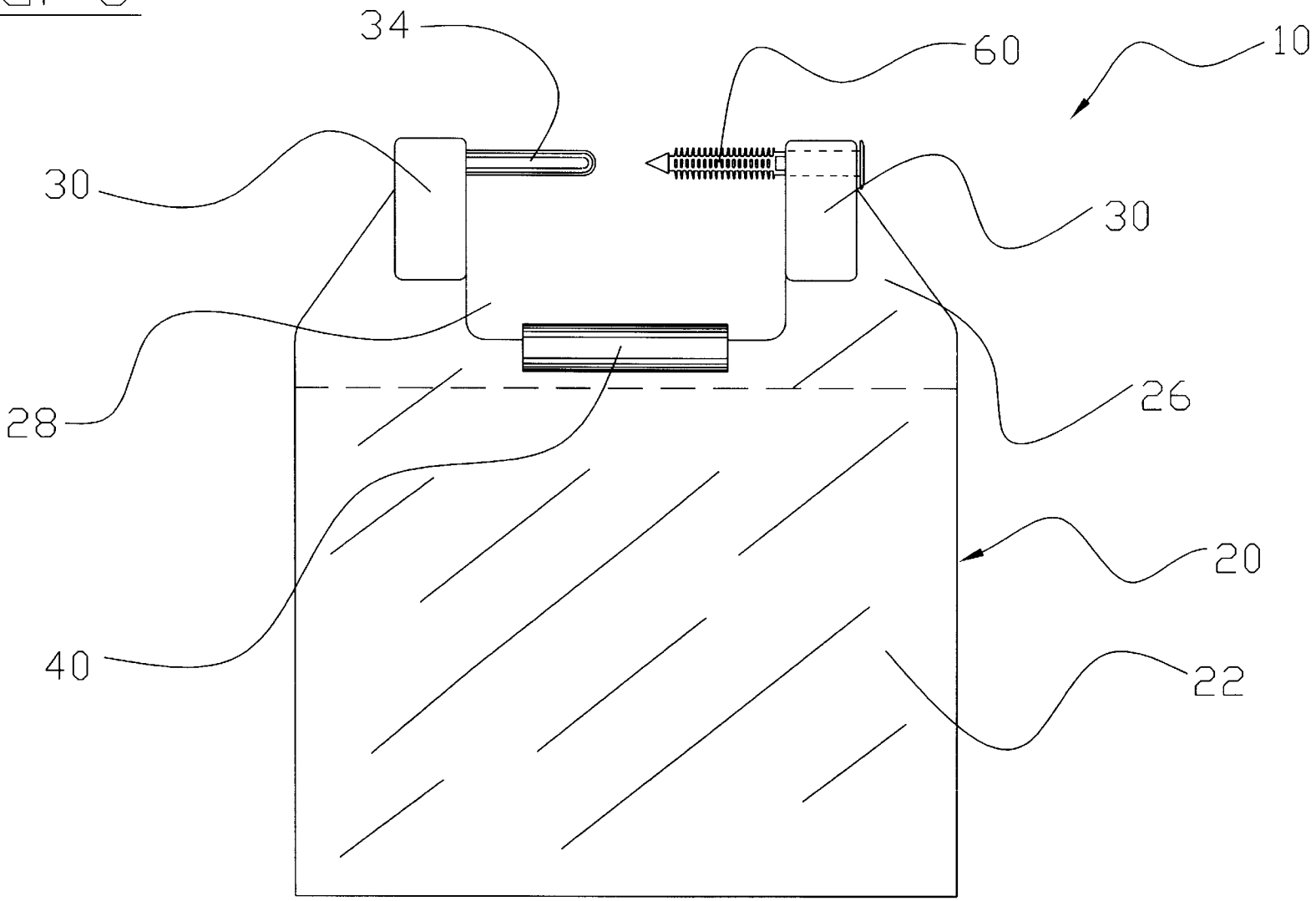
FIG. 5 is a front view of the present invention.
Figure 7:
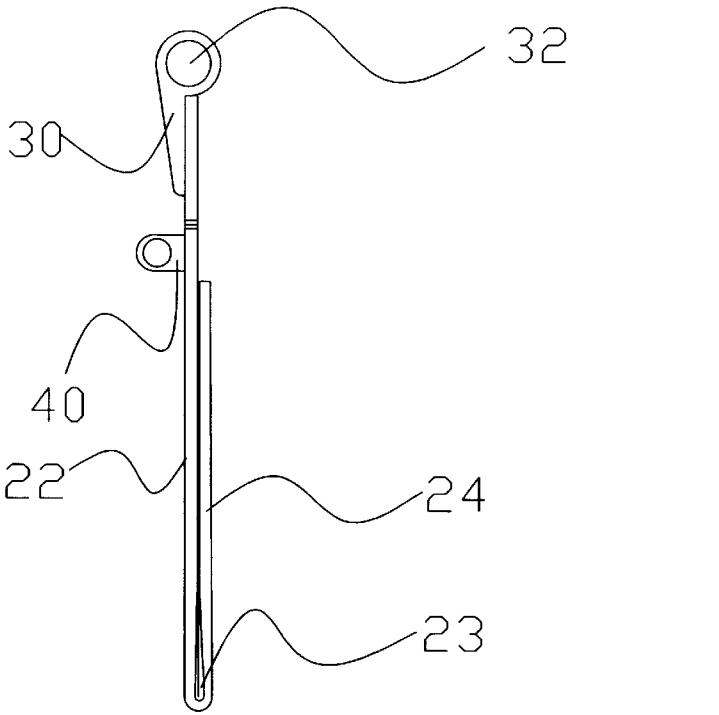
FIG. 7 is a right side view with a promotional sheet positioned within the retaining device.

As best shown in FIG. 5 of the drawings, a pair of necks 26 extend from the upper portion 22. The pair of necks 26 preferably taper inwardly from the outer portions however various shapes and designs may be utilized to construct the necks 26. The pair of necks 26 define a cutout 28 between thereof as further shown in FIG. 5 of the drawings. The cutout 28 is formed for receiving the clip member 16 that is secured to a writing pad 14 of a conventional golf cart. As shown in FIGS. 1 through 3 of the drawings, a pencil holder 40 is attached to the upper portion 22 of the retaining device 20 for receiving one or more writing devices such as pencils and pens.

As best shown in FIG. 5, a pair of brackets 30 are attached to and extend from the distal portions of the necks 26. As best shown in FIGS. 2 and 3 of the drawings, the brackets 30 are formed to extend about the side portions of the clip member 16 secured to the writing pad 14. A pin 34 extends from one of the brackets 30 and is positionable within a side bore extending into the side of the clip member 16. An aperture 32 extends through one of the brackets 30 for receiving an elongated locking member 60 opposite of the pin 34. The locking member 60 is catchably received within the aperture 32 by various well-known means for fasteners such as threads, securing material such as glue or other well-known systems. The locking member 60 is preferably an elongated structure such as a fastener that is capable of extending through the aperture 32 of the brackets 30 and into one of the side bores of the clip member 16.

Figure 6:
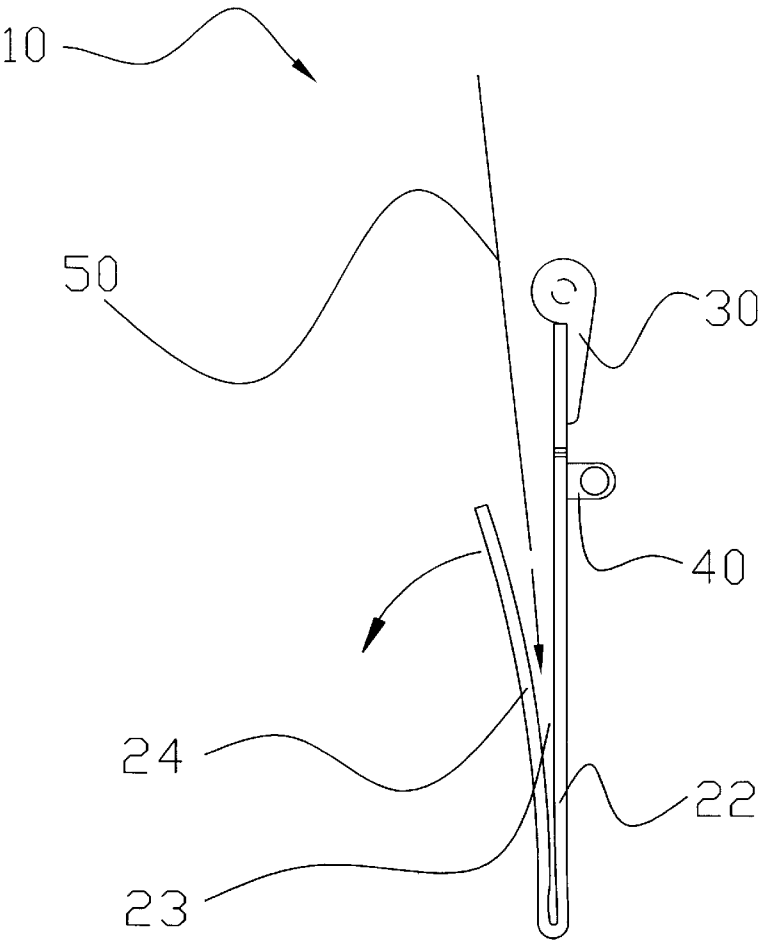
FIG. 6 is a left side view with a promotional sheet positioned within the retaining device.
Figure 9:
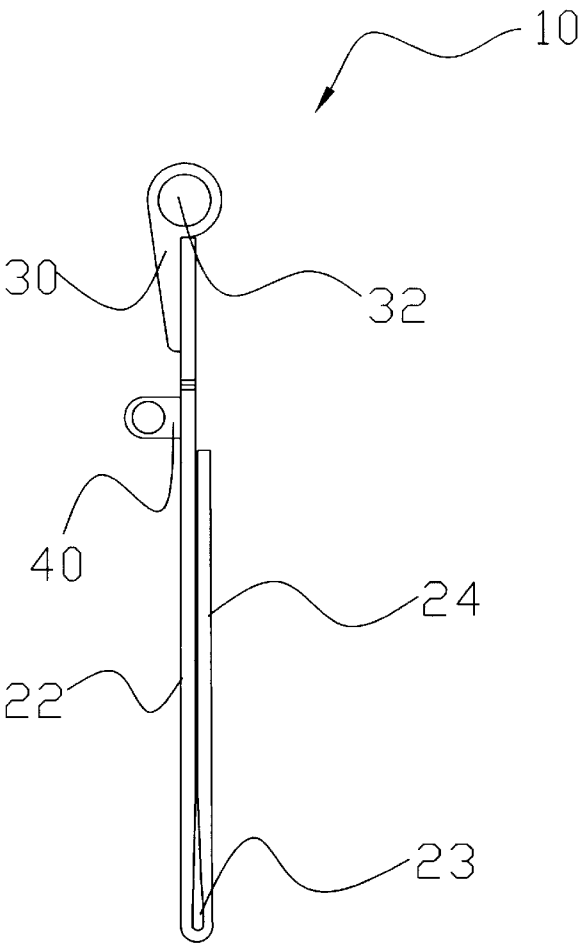
FIG. 9 is a right side view of the present invention.
Figure 8:
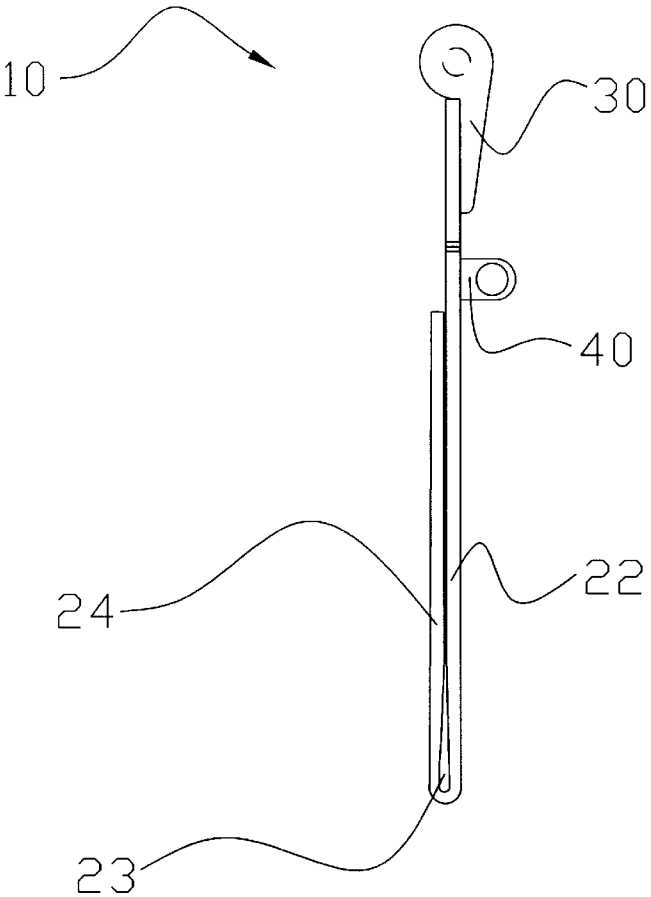
FIG. 8 is a left side view of the present invention.

In use, the golf cart promotional system 10 is installed by inserting the pin 34 into one of the side bores contained within the clip member 16. The locking member 60 is then inserted into the aperture 32 of the brackets 30 opposite of the pin 34 until the locking member 60 is pivotally positioned into the side bore of the clip member 16 opposite of the pin 34. The locking member 60 is catchably retained within one of the brackets 30 for preventing accidental removal of the golf cart promotional system 10. The promotional sheet 50 may be installed or removed while the golf cart promotional system 10 is installed or removed from the writing pad 14. The promotion sheet 50 is positioned within the retaining device 20 by the user manipulating the lower portion 24 with respect to the upper portion 22 thereby widening the slot 23 between thereof as shown in FIG. 6 of the drawings. The user then inserts the promotional sheet 50 into the slot 23 until properly positioned and then releases the lower portion 24 to return adjacent the upper portion 22 thereby securably retaining the promotional sheet 50 between thereof. The golf cart promotional system pivots upwardly to provide access to a scorecard 18 attached to the clip member 16 and then pivots downwardly to protect the scorecard 18 and allows the golfer to view and interact with the promotional sheet 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A golf cart promotional system, comprising:

a retaining device having a rectangular shape for receiving at least one promotional sheet; and a bracket structure attached to said retaining device for securing to a first side bore and a second side bore within a clip member of a golf cart;

wherein said retaining device is comprised of an upper portion secured to said bracket structure, and a lower portion secured to said upper portion opposite of said bracket structure defining a slot between thereof for receiving said at least one promotional sheet;

wherein said lower portion is shorter in length than said upper portion;

wherein said bracket structure is pivotally attached to said clip member;

wherein said bracket structure is comprised of:

a first bracket and a second bracket attached to said upper portion extending a finite distance from thereof and defining a cutout for receiving said clip member;

a pin extending from said first bracket that extends into said first bore;

an aperture extending through said second bracket; and a locking member catchably retained within said aperture of said second bracket and extending into said second bore.

2. The golf cart promotional system of claim 1, including a pencil holder secured to said upper portion.

3. The golf cart promotional system of claim 1, wherein said retaining device is comprised of a transparent material.

4. The golf cart promotional system of claim 1, wherein said retaining device is comprised of a semi-transparent material.

5. The golf cart promotional system of claim 1, wherein said locking member is comprised of an elongated fastener.

6. A golf cart promotional system, comprising:

a retaining device for receiving at least one promotional sheet having a neck portion with a cutout within positionable about a clip member of a writing pad; and a bracket structure attached to said neck portion of said retaining device for securing to a first side bore and a second side bore within said clip member of a golf cart;

wherein said retaining device is comprised of an upper portion secured to said neck portion, and a lower portion secured to said upper portion opposite of said bracket structure defining a slot between thereof for receiving said at least one promotional sheet;

wherein said lower portion is shorter in length than said upper portion;

wherein said lower portion and said upper portion are rectangular shaped;

wherein said bracket structure is pivotally attached to said clip member;

wherein said bracket structure is comprised of:

a first bracket and a second bracket attached to said upper portion extending a finite distance from thereof and defining said cutout for receiving said clip member;

a pin extending from said first bracket that extends into said first bore;

an aperture extending through said second bracket; and a locking member catchably retained within said aperture of said second bracket and extending into said second bore.

7. The golf cart promotional system of claim 6, including a pencil holder secured to said upper portion.

8. The golf cart promotional system of claim 6, wherein said retaining device is comprised of a transparent material.

9. The golf cart promotional system of claim 6, wherein said retaining device is comprised of a semi-transparent material.

10. The golf cart promotional system of claim 6, wherein said locking member is comprised of an elongated fastener.

11. A golf cart promotional system, comprising:

a retaining device having an upper portion for receiving at least one promotional sheet; and a bracket structure attached to said retaining device for securing to a first side bore and a second side bore within a clip member of a golf cart;

wherein said bracket structure is comprised of a first bracket and a second bracket attached to said upper portion extending a finite distance from thereof and defining a cutout for receiving said clip member, a pin extending from said first bracket that extends into said first bore, an aperture extending through said second bracket, and a locking member catchably retained within said aperture of said second bracket and extending into said second bore.

12. The golf cart promotional system of claim 11, including a pencil holder secured to said upper portion.

13. The golf cart promotional system of claim 11, wherein said retaining device is comprised of a transparent material.

14. The golf cart promotional system of claim 11, wherein said retaining device is comprised of a semi-transparent material.

15. The golf cart promotional system of claim 11, wherein said locking member is comprised of an elongated fastener.

* * * * *